US009744410B1

(12) United States Patent
Foster

(10) Patent No.: US 9,744,410 B1
(45) Date of Patent: Aug. 29, 2017

(54) GOLF SHAFT FLEX CONNECTION

(71) Applicant: John Thomas Foster, Allison Park, PA (US)

(72) Inventor: John Thomas Foster, Allison Park, PA (US)

(73) Assignee: John Thomas Foster, Allison Park, PA (US)

( * ) Notice: Subject to any disclaimer, the term of this patent is extended or adjusted under 35 U.S.C. 154(b) by 0 days.

(21) Appl. No.: 15/016,726

(22) Filed: Feb. 5, 2016

(51) Int. Cl.
*A63B 53/02* (2015.01)
*A63B 53/00* (2015.01)

(52) U.S. Cl.
CPC ..... *A63B 53/00* (2013.01)

(58) Field of Classification Search
CPC ..... A63B 53/02
USPC ..... 473/305, 310
See application file for complete search history.

(56) References Cited

U.S. PATENT DOCUMENTS 1,669,836 A * 5/1928 Neuberth ..... A63B 53/02 473/305
1,704,544 A * 3/1929 Novak ..... A63B 53/14 16/DIG. 30
1,983,069 A * 12/1934 Cowdery ..... A63B 53/02 473/310
3,572,709 A * 3/1971 Risher ..... A63B 53/02 403/23
3,625,513 A * 12/1971 Ballmer ..... A63B 53/02 473/310
4,340,227 A * 7/1982 Dopkowski ..... A63B 53/02 206/315.2
4,984,794 A * 1/1991 Pernelle ..... A63B 53/02 473/305
5,318,300 A * 6/1994 Schmidt ..... A63B 53/04 473/305

(Continued)

FOREIGN PATENT DOCUMENTS

DE 1939371 A1 * 2/1970 ..... A63B 53/02
SE WO 0020075 A1 * 4/2000 ..... A63B 53/02

*Primary Examiner* — William Pierce

(57) ABSTRACT

A shaft insert (or external connecting segment) with greater flexibility than the substrate shaft allowing for a more flexible zone in an area of separation between two separated portions of the substrate shaft. The flexible connection is intended to be installed between two segments of the separated substrate shaft primarily on a golf putter with the flexible connection within 5 inches of the base of the club in total compliance with USGA (United States Golf Association) Rule 2, Appendix II. 2. b. requiring any change from the continuous shaft be within 5 inches of the club base. The shaft flex connection is designed to be symmetrical around its cross section with equal flexibility and torsional displacement in all directions in compliance with USGA Rule 2, Appendix 2. c. requiring golf shafts to be equally flexible with equal torsional displacement in all directions. The preferred embodiment of the invention utilizes a flexible tube for which the outside diameter is slightly smaller than the inside diameter of the substrate shaft. The substrate shaft is separated at the top of the hosel of the club and joined by fixing the tube (with epoxy or other adhesive) in each section of the separated sections of the substrate shaft whereby the separation is maintained at a fixed distance by installing an O ring or other spacer over the insert tube and between the two segments of the substrate shaft.

3 Claims, 4 Drawing Sheets

(56) References Cited

U.S. PATENT DOCUMENTS 5,362,048 A * 11/1994 Haste ..... A63B 53/02 473/232
5,377,979 A * 1/1995 Long ..... A63B 53/007 273/DIG. 8
5,976,031 A * 11/1999 Johnson ..... A63B 53/00 473/300
6,033,318 A * 3/2000 Drajan, Jr. ..... A63B 53/02 473/309
6,050,903 A * 4/2000 Lake ..... A63B 53/02 473/244
6,371,865 B1 * 4/2002 Magliulo ..... A63B 53/00 473/256
6,634,958 B1 * 10/2003 Kusumoto ..... A63B 53/02 473/310
6,890,266 B2 * 5/2005 Solheim ..... A63B 53/02 473/246
7,083,529 B2 * 8/2006 Cackett ..... A63B 53/02 473/309
7,802,373 B1 * 9/2010 Diesterheft ..... A63B 53/02 33/508
7,976,401 B2 * 7/2011 Sato ..... A63B 53/02 473/288
8,088,019 B1 * 1/2012 Long ..... A63B 53/02 473/245
8,529,367 B2 * 9/2013 Evans ..... A63B 53/10 473/296
8,535,172 B2 * 9/2013 O'Shea, III ..... A63B 53/02 473/288
8,715,103 B1 * 5/2014 Aguinaldo ..... A63B 53/02 473/246
2003/0181255 A1 * 9/2003 Ho ..... A63B 53/00 473/316
2004/0100024 A1 * 5/2004 Johnson ..... A63B 53/02 273/287
2005/0079923 A1 * 4/2005 Droppleman ..... A63B 53/00 473/287
2007/0173344 A1 * 7/2007 Burch ..... A63B 53/02 473/305
2008/0293510 A1 * 11/2008 Yamamoto ..... A63B 53/02 473/308
2010/0234123 A1 * 9/2010 Sato ..... A63B 53/02 473/307
2014/0080617 A1 * 3/2014 Llewellyn ..... A63B 53/02 473/246
2014/0213386 A1 * 7/2014 Yamamoto ..... A63B 53/00 473/307
2014/0352162 A1 * 12/2014 Holtzman ..... G01B 5/0023 33/508
2016/0016051 A1 * 1/2016 Dacey ..... A63B 53/02 473/305
2016/0059093 A1 * 3/2016 Nielson ..... A63B 53/02 473/338

* cited by examiner

GOLF SHAFT FLEX CONNECTION

BACKGROUND OF THE INVENTION

1. Field of the Invention

The invention relates to golf club shafts and golf club needs particularly as applied to putters. In particular this invention allows the face of the putter to decrease in loft (moving more to a vertical face) upon impact with the golf ball more efficiently imparting roll to the golf ball.

2. Discussion of Related Art

One of the most important parts of a golfer's game is accurate putting thus minimizing the number of strokes needed to complete a round. For example on a par 4 hole a typical stroke rating is two strokes to reach the green and two putts to get the ball into the hole thus 50% of the strokes that a golfer is rated to take is in putting. Par 5 holes usually rate 3 strokes of driver and fairway play with two putts to get the ball into the hole and par 3 holes rate one T shot and two putting strokes to complete the hole. On average the are an equal number of par 3 and par 5 holes on a golf course with the balance made up of par 4 holes again with the rating versus par 50% of the strokes that a golfer would apply in a round are putts.

Given the importance of accurate putting, great attention has been paid to putter design to accommodate and enhance a golfer's ability to accurately putt. Since there are quite a number of approaches to accurate putting, sanctioning bodies such as the USGA and Royal and Ancient have allowed great latitude in putter design and configuration well beyond that of clubs designed for driving and fairway play. Wide variations club head size and shape, shaft length, and grip size and shape are all within the major sanctioning bodies' rules of putter design.

One issue that has affected putting accuracy is the tendency of the ball to become airborne upon being struck by the face of the putter. The ball becomes airborne (slightly) due primarily to the need to overcome the rotational moment of inertia of the golf ball by applying an axial force at or near the equator of the ball. Since little or no tangential component of force is exerted on the ball, the ball becomes airborne due to frictional resistance between the putting surface and the ball to the applied axial force causing the ball to roil up the face of the putter when struck. While this phenomenon is desirable for fairway play with other clubs it impacts putting accuracy as the ball "skips" in the direction of the axial force as opposed to rolling along the intended line of the putt which is often a curved path since putting greens are not totally flat. This phenomenon of becoming airborne is more prevalent on longer putts where the ball is more firmly struck, imparting a higher axial force and opposite vector frictional force with significant impact on accuracy.

With the flexible connection installed in the shaft, the loft of the putter face, typically a few degrees negative (less than 10 degrees in accordance with USGA rules) from vertical, changes upon impact toward neutral or slightly positive (top of the putter face moves toward the ball). The degree of change in loft is proportional to the force of the strike. This change in loft is analogous to moving a hand from the side of the ball to the top of the ball immediately imparting roll to the ball and not allowing the ball to ride up the face of the putter becoming airborne. In physical terms a tangential, rotational force, is impacted to the ball along with an axial force providing simultaneous translation and rotation to the ball.

While shaft inserts are common in the reference patents cited, shaft inserts such as the reference U.S. Pat. No. 7,500,921 B2 all utilize shaft inserts of varying design to alter stiffness or damping properties without a space between shaft segments. In addition, none of the prior art cited are designed to permit an enhanced loft change in a putter head during the strike of the golf ball.

OBJECTS AND SUMMARY OF THE INVENTION

It is therefore a primary objective of the invention to provide a change in loft of the putter face from more negative (top of the putter face further away from the ball than the base of the putter face) to a position where the top of the putter face moves closer to the ball upon impact. This change in putter face angle is intended to more efficiently impart a tangential force in the direction of the top of the ball providing more efficient roll to the ball on the putting surface thus improving accuracy by allowing the ball to roll and not skip along the intended line of the putt.

It is another objective of the invention to provide added damping at impact provided by the added flexibility of the shaft just above its rigid connection to the putter head. The added damping of the stroke allows for a softer touch on particularly fast greens.

It is a third objective of the invention that the O ring (or other spacer) that provides for a fixed space between the two substrate shaft sections limits torsional movement (but equal left or right in accordance with Rule 2, Appendix 2. c,) between the two shaft substrate sections by increasing torsional friction in the area of separation. The spacer or multiple spacers will also fix the degree of flexibility between the shaft sections.

In accordance with the first objective of the invention, the combination of the flexible shaft insert and inherent flexibility of the O ring spacer(s) added flexibility at the point just above the fixed connection of shaft to putter head is achieved. Bending flexibility is equal in all directions as well as torsional flexibility where said bending flexibility allows for the putter face angle to change as the ball is struck imparting more efficient roll to the ball.

In accordance with the second objective of the invention the added compliance between the separated sections of the shaft provided by the insert design results in a dampened strike of the ball allowing for a softer touch on particularly fast greens.

In accordance with the third objective of the invention, the added torsional friction between the separated shaft sections provided by the O ring (and or other spacers of varying design) allows for maintained accuracy on off center strikes of the ball by limiting displacement of the putter head left or right of the intended perpendicular line of the putt.

Also, tuning of the durometer of the O ring or rings or spacers and insert stiffness used allows for optimum flexibility for a range of putting applications.

Other objects, features and advantages of the present invention will become apparent to those skilled in the art from, with the following detailed description, and the accompanying drawings. It should be understood, however that the detailed description and specific examples, while indicating preferred embodiments of the present invention, are given by way of illustration and not limitation. Many changes and modifications may be made within the scope of the present invention without departing from the intended function thereof which is to provide for a putter face change in loft during the strike of the ball, and the invention includes all such modifications.

BRIEF DESCRIPTION OF DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

1. Resumé

Figure 1:
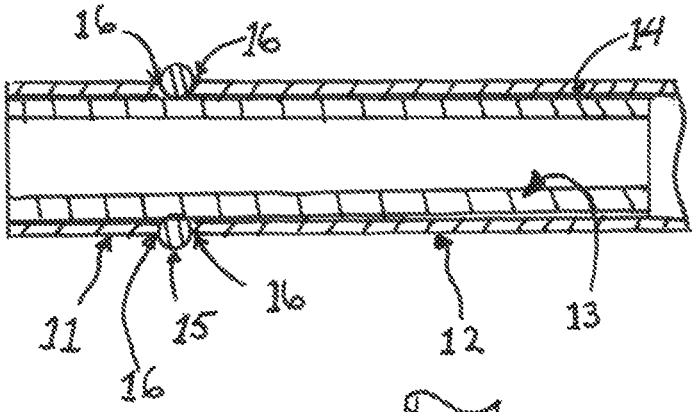
FIG. 1 is a sectional view of the conventional golf shaft with separation between the parts with insert and O ring installed.

Pursuant to the preferred embodiment of the invention, a flexible shaft insert is composed of flexible nylon or other flexible tubing (or solid flexible shape) with an outside diameter matching or with clearance compared to the inside diameter of the substrate more rigid shaft. This insert is installed inside the shaft such that it bridges a separation between shaft portions which are separated by as little as 0.001 inch to any maximum distance that will provide the desired flexibility between the two portions of the substrate shaft. The separation in the substrate shaft is sized such that the lower portion of the shaft can be fixed inside the hosel or putter body with the separation occurring at the top of the hosel or putter body (depending on putter and shaft mounting design). At the top of the putter body or hosel, the O ring spacer (or alternate spacers) with an inside diameter matching the outside diameter of the flexible insert covering the space between the substrate shaft sections and resting on the putter body or top of the hosel. All connections are made between; insert and shaft segments, shaft and putter head or hosel, O ring or O rings and flexible insert using conventional cementing adhesive commonly used for such connections.

2. Construction and Operation of a First Preferred Embodiment and Possible Alternates Referring now to FIGS. 1-9 the exemplary putter illustrated in side view by FIG. 9 includes an upper shaft section 12, with lower section 11 inserted into hosel section 17 which is part of putter head 18 and shaft sections 11 and 12 connected by flexible shaft insert 13 with the fixed distance between shaft sections 11 and 12 fixed by flexible O ring (or alternate spacer) 15. The O ring 15 in FIG. 9 is shown in section but in fact is continuous around the circumference of the shaft and insert. The golfer holds and moves the putter at grip 33.

Although the present invention is not limited to any particular putter configuration or golf club for that matter, the exemplary club shown is a putter with raised hosel on putter stem 19. The present invention is, however equally applicable to any golf club or putter configuration and not limited to shaft design or shaft or insert material.

Figure 8:
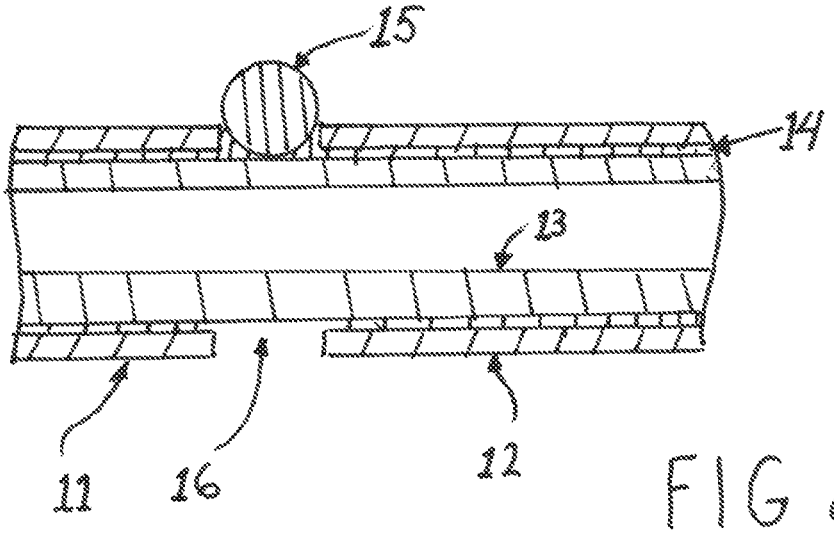
FIG. 8 is an amplified view of the preferred embodiment shown in FIG. 1 showing a more detailed view of the shaft sections as well as the epoxy or adhesive location. The O ring is not shown on one side of the gap between shaft sections for clarity.
Figure 9:
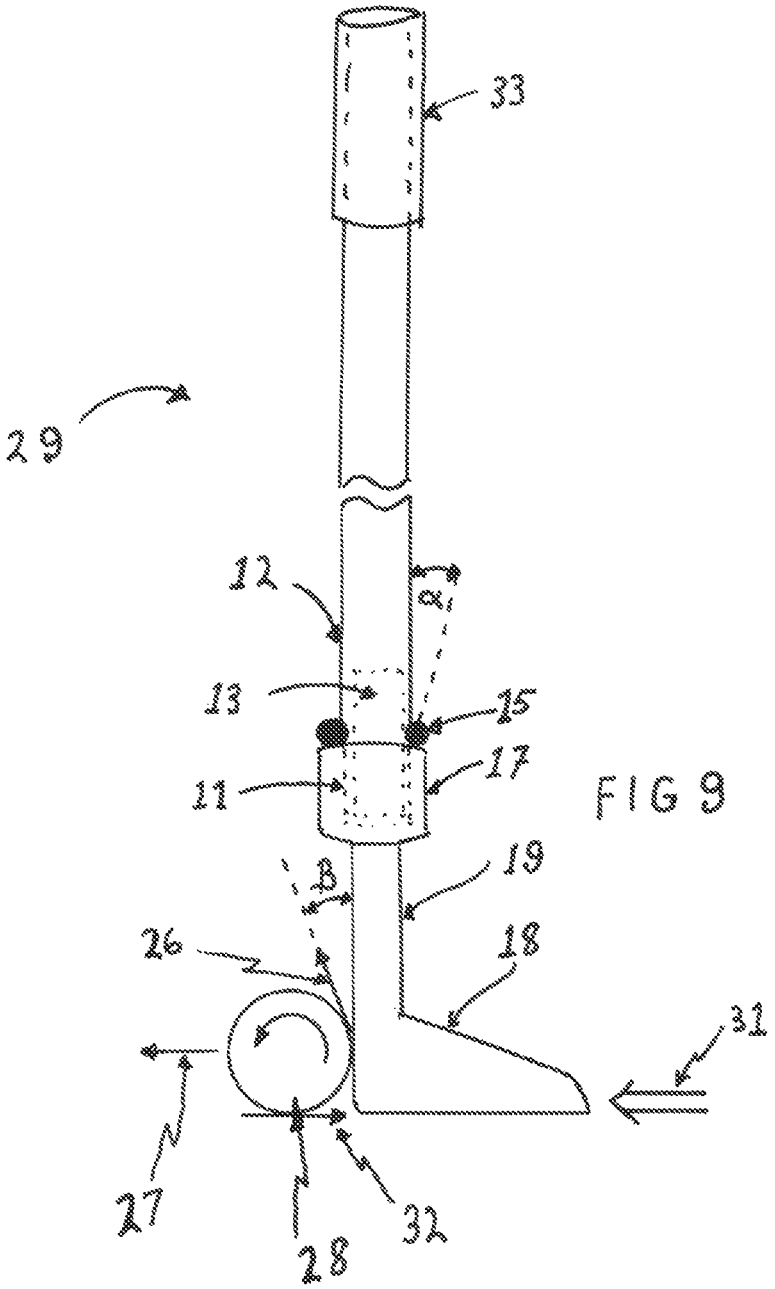
FIG. 9 is a modified free body diagram showing a right handed player side view of the preferred embodiment that shows the direction of displacement of the upper shaft section and resultant putter face displacement during the strike and resulting reaction of the golf ball.

Turning to the insert assembly illustrated first by FIGS. 1 and 8, a golf shaft lower section 11 is separated from a golf shaft upper section 12 leaving a gap 16. Note that in FIG. 8 O ring 15 is not shown on one side for clarity to show gap 16. The shaft sections 11 and 12 are joined by flexible insert 13 and separated by O ring 15 installed over the gap 16. The flexible insert 13 is fixed to the shaft surface at points of contact by epoxy or other adhesive 14. The O ring 15 is also fixed to the exposed surface of the insert 13 at the controlled gap 16 with epoxy or other adhesive 14.

Figure 2:
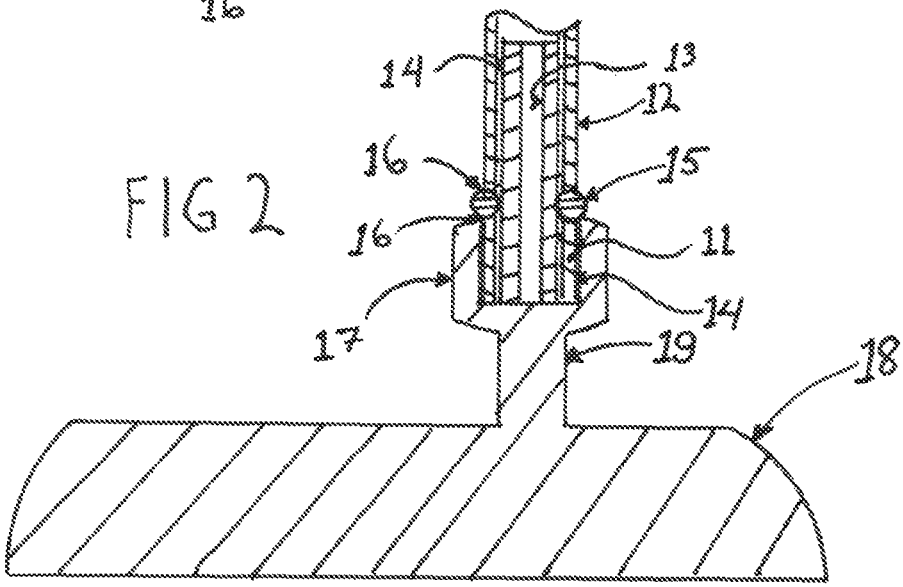
FIG. 2 is a sectional view of the rigid fitment of the lower portion of the shaft to the putter hosel with separation and O ring spacer just above the rigid fitment. The insert is also shown bridging the lower and upper portions of the separated shaft.

As illustrated by FIG. 2, the lower section of the golf shaft 11 is installed into the hosel 17 using adhesive 14 with O ring 15 resting on top of hosel 17.

Figure 3:
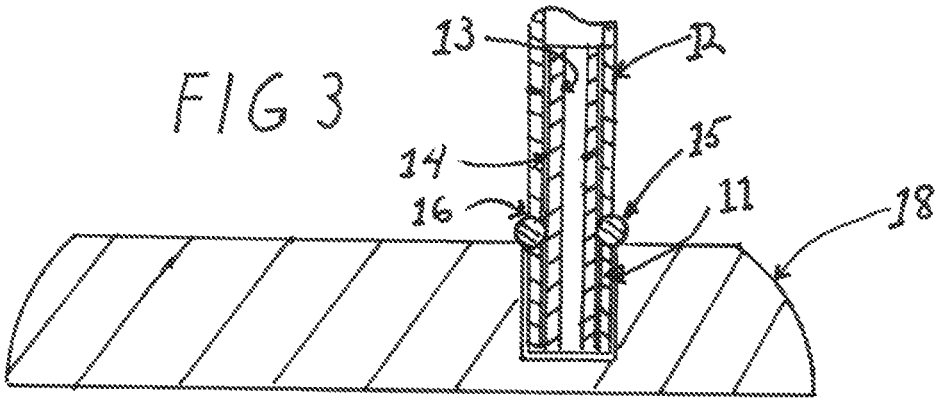
FIG. 3 is a sectional view of the shaft and insert installation in the body of a putter without a hosel.

As illustrated by FIG. 3, alternately the shaft lower section 11 is shown in putter body 18 using adhesive 14 with gap 16 coincident with O ring 15 resting on top of putter body 18 which is an illustrated connection method for putters without a raised hosel.

Figure 4:
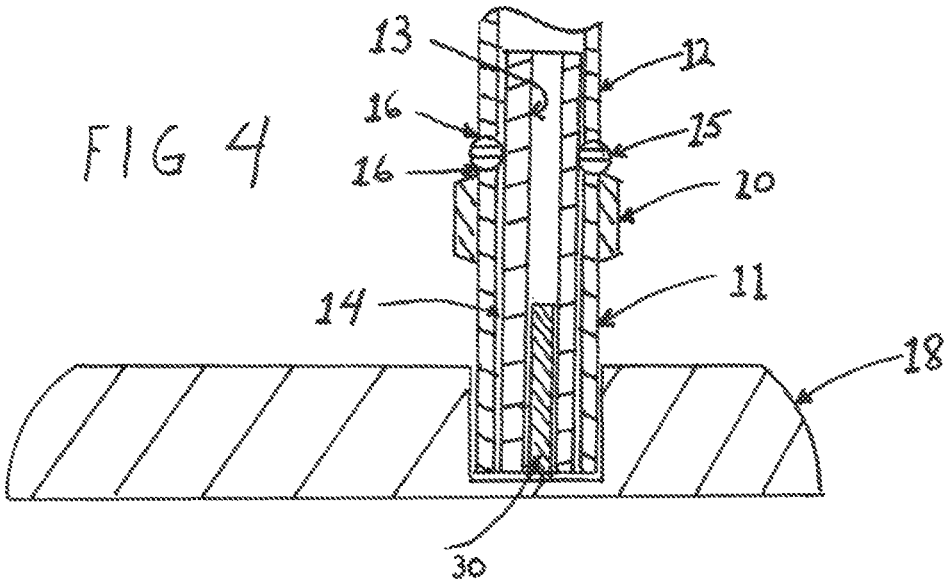
FIG. 4 is a view of the shaft and insert installation in a putter head without hosel and with flex point above the putter body.

FIG. 4 shows an alternate for accommodating a third type of popular putter connection, with coincidental separation and O ring 15 and 16 oriented above putter head 18. The insert 13 and lower shaft section 11 can be installed over putter stem 30 which is either located within the putter head 18 or as an extension of the putter head 18. Optional non flexible collar 20 is fixed below O ring 15 and in contact with bottom of O ring 15 if additional stability in flex and torsional control is required. All points are secured with adhesive 14.

Figure 5:
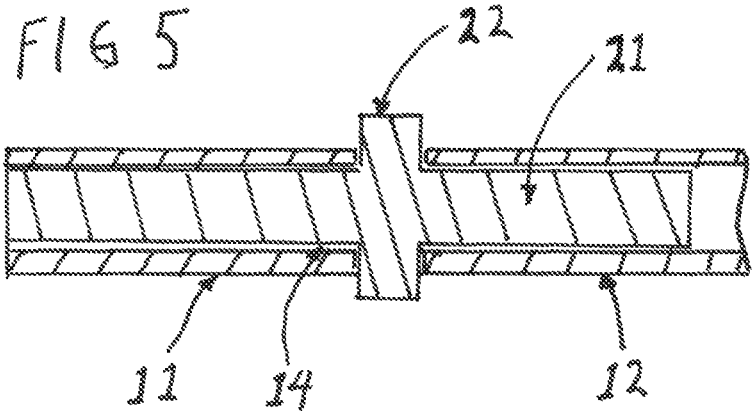
FIG. 5 is a view of an alternate single piece flexible connection between two separated portions of a shaft.

While many alternates to the preferred embodiment of the invention are possible, FIG. 5 illustrates a first alternate to the preferred embodiment of the invention shown by alternate insert 21 which is single molded piece integrating a collar 22 which replaces the O ring 15 of the first preferred embodiment. All portions are attached to lower shaft section 11 and upper shaft section 12 with adhesive 14. While the sectional view of alternate insert 21 shows the insert as solid it can also be hollow.

Figure 6:
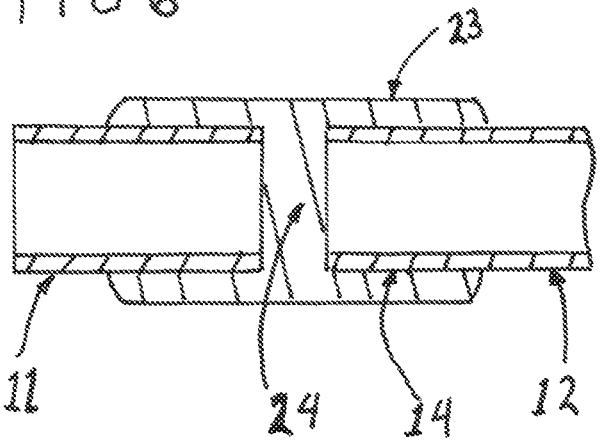
FIG. 6 is a sectional view of a flexible collar over the shaft sections providing the same functions as the insert

Another possible alternate to the preferred embodiment of the invention which retains the same principle of allowing added flexibility between shaft sections is shown by FIG. 6 demonstrating an outside flexible collar 23 with integrated or separate spacer 24 separating shaft lower section 11 and shaft upper section 12 with all surfaces in contact with shaft section 11 and shaft section 12 secured with epoxy or other adhesive 14.

Figure 7:
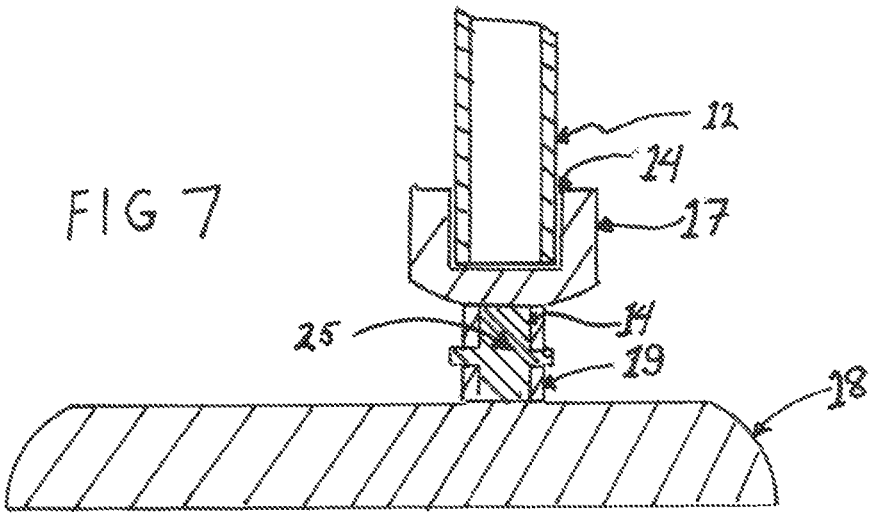
FIG. 7 is a view of an alternate putter stem insert providing toe same putter face reaction as the shaft insert

The principle of the invention is not limited to adding a point of increased flexibility to the shaft. As illustrated by FIG. 7, similar flexible sections can be integrated into the putter head as exemplified by the flexible stem insert 25 inserted between two separate sections of putter stem 19 that connects hosel 17 and putter body 18.

Returning to FIG. 9, the principle of the invention is illustrated by this modified free body diagram whereby when the putter is moved in positive direction 31 initiating contact with stationary golf ball 28, the following reactions take place:

Inertial resistance of the stationary golf ball 2B results in coincidental deflection of flexible connection 13 by variable angle $\alpha$.

The result of the deflection angle $\alpha$ caused by the resisting inertia of the golf ball and the force of the strike by putter head 18, is a coincidental deflection of the putter head along variable camber angle B.

Due to the creation of camber angle B by the added flexibility of insert 13, tangential force vector 26 is created which imparts improved roll to the golf ball 28.

In the absence of camber angle B during the strike by putter head 18, only force vector 27 exists which is resisted by the frictional force vector 32 between the golf ball 28 and the putting surface resulting in the tendency of the golf ball to become airborne thus resulting in a skipping action that reduces accuracy of the putt.

Of course, many modifications could be made to the invention as described and illustrated without departing from the spirit of the present invention. The scope of such changes will become apparent from the appended claims.

What is claimed is:

1. A Golf club comprising:

A golf club head with a cylindrical insertion hole;

a lower tubular shaft inserted into a distal end of said golf club head insertion hole and terminating flush with a top of said golf club head insertion hole whereby said lower tubular shaft is secured to said golf club head with adhesive;

an upper tubular shaft with inside diameter and outside diameter corresponding to said lower shaft inside diameter and outside diameter;

an flexible cylindrical insert with outside diameter essentially corresponding to the inside diameter of said upper tubular shaft and corresponding to the inside diameter of said lower tubular shaft inserted into a distal end of the upper tubular shaft and inserted into a distal end of said lower tubular shaft whereby said cylindrical insert is secured to said lower tubular shaft with adhesive and secured to said upper tubular shaft with adhesive;

an flexible ring with inside diameter essentially corresponding with the outside diameter of said flexible cylindrical insert and outside diameter essentially corresponding with outside diameter of said lower shaft and said upper shaft whereby said flexible ring is place over the flexible cylindrical insert such that it is between the upper and lower tubular shafts and is in contact with said upper tubular shaft.

2. A golf club in accordance with claim 1, wherein said cylindrical insert is coaxial with said lower tubular shaft and said cylindrical insert is also coaxial with said upper tubular shaft such that said lower tubular shaft is coaxial with said upper tubular shaft.

3. A golf club in accordance with claim 1, wherein said flexible ring is helical.

* * * * *